United States Patent [19]

Zdarsky et al.

[11] 4,286,714

[45] Sep. 1, 1981

[54] SLEEVE WITH PRE-APPLIED HANDLE FOR SETUP BOX OR FOLDING CARTON

[75] Inventors: Robert C. Zdarsky, Westchester; Russell J. Lyons, Franklin Park, both of Ill.

[73] Assignee: Champion International Corporation, Stamford, Conn.

[21] Appl. No.: 86,467

[22] Filed: Oct. 19, 1979

[51] Int. Cl.[3] ..... B65D 5/46

[52] U.S. Cl. ..... 206/526; 229/52 A; 229/52 AL

[58] Field of Search ..... 206/526, 428, 434, 161, 206/162, 170; 229/52 A, 40, 10, 52 AL; 224/45 R

[56] References Cited

U.S. PATENT DOCUMENTS

| | | | |
|---|---|---|---|
| 2,233,799 | 3/1941 | Seifer et al. | 229/52 A |
| 2,648,645 | 6/1953 | Brown | 229/52 A |
| 3,266,687 | 8/1966 | Isoldi | 224/45 R |
| 3,416,648 | 12/1968 | Levi | 229/10 |
| 3,495,760 | 2/1970 | Poth | 229/40 |
| 3,801,012 | 4/1974 | Thelen | 229/52 AL |

*Primary Examiner*—William T. Dixson, Jr.

*Attorney, Agent, or Firm*—Evelyn M. Sommer

[57] ABSTRACT

A sleeve with pre-applied handle for a setup box or a folding carton, wherein the sleeve is formed to match a cross-sectional dimension of the box or carton and be slipped on in close frictional engagement therewith. The sleeve comprises a pair of side walls and top and bottom walls hingedly connected by fold lines to form a tubular structure which is collapsible about the fold lines. A handle is provided in the top wall. The top wall is formed of two panels, one extending from each of the side walls and the panels overlying each other. The handle is secured to the upper surface of the lower of the two panels forming the top wall and extends through a slot in the upper of the two panels forming the top wall. The ends of the handle are secured between the two panels and are further adhesively secured by a sheet having openings through which the ends of the handle may extend into engagement with the upper surface of said lower panel of said top wall to further ensure securement. The handle is pleated or prefolded at at least one end so that it may be collapsed without distortion into the top panel within the area defined by the slot.

4 Claims, 5 Drawing Figures

FIG. 1.
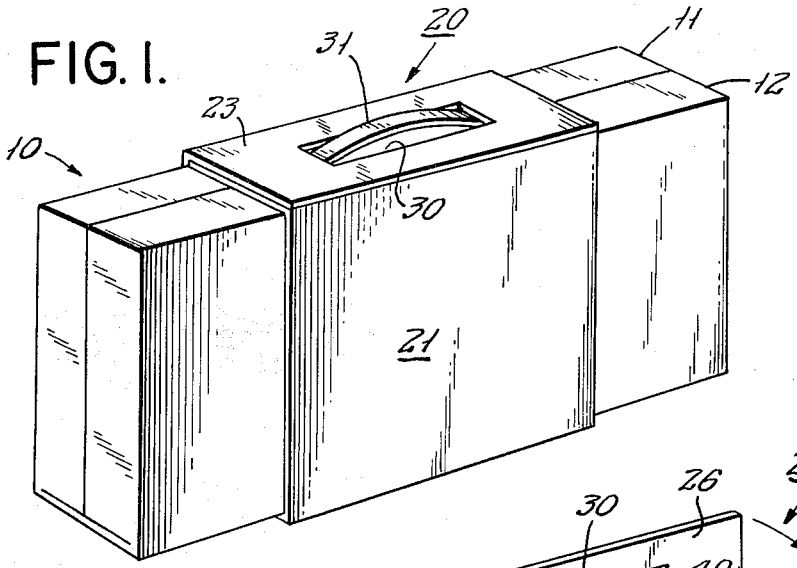
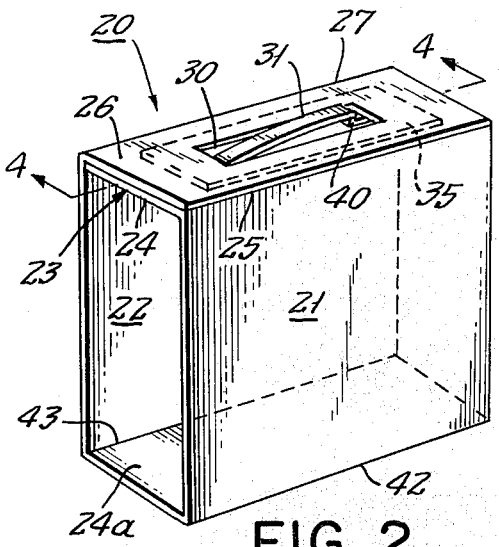
FIG. 2.
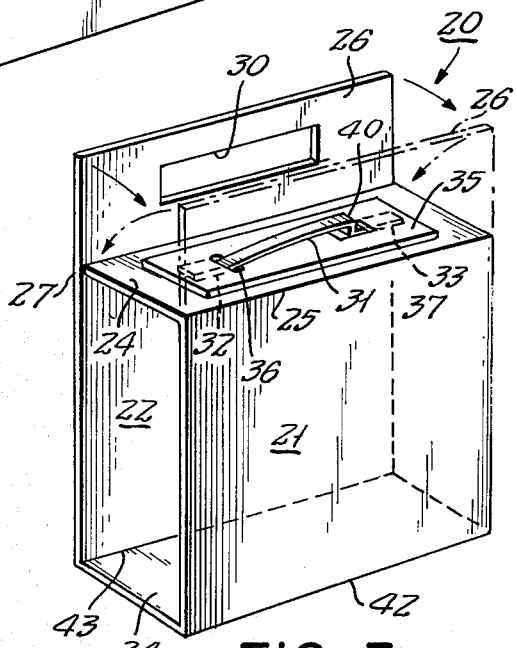
FIG. 3.
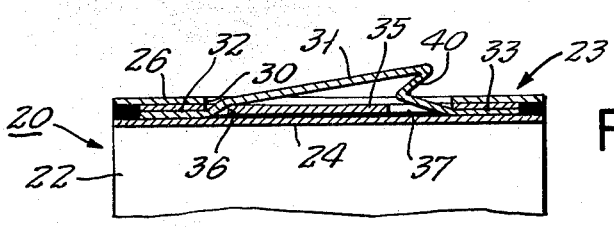
FIG. 4.
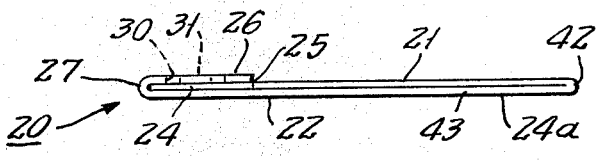
FIG. 5.

SLEEVE WITH PRE-APPLIED HANDLE FOR SETUP BOX OR FOLDING CARTON

The present invention relates to packaging materials and particularly to a handled sleeve for a package or box which fits one circumferential dimension of the box closely and provides a means for rapidly applying a closure and securement for the box while at the same time also providing a handle for the box.

In the utilization of boxes, particularly in consumer oriented outlets such as retail stores and department stores, the boxes are usually provided either as a one piece box folded and scored in such a manner that the bottom and top are connected but may be hingedly closed or as a separate bottom container and top lid. In either case, some kind of handle arrangement may be provided integral with the box itself and, in fact, in the folding boxes wherein the top and bottom are made from a single blank, the handle may also be used as the means for maintaining the box in closed position.

However, the folding box with integral cover and base are stored in flat condition and require erection to the completed and closed position around the merchandise by either the salesman, cashier or packer and it often happens that the box although intended to present a substantially acceptable outward appearance takes time to erect and to enclose the merchandise and is not always securely closed.

Where a separate bottom container and top cover are used for boxes such as, for instance, garment boxes, the storage problem becomes substantial since such boxes are frequency not made in collapsed condition. Where they are made and stored in collapsed condition, the process of erecting and interlocking the sides of the bottom container and of the top lid may be so time consuming at the point of sale package or delivery to the customer that is represents a bottleneck which is not acceptable in normal retail merchandising.

In addition, and in particular, where no integral locking arrangement is provided for the box, the box must be tied either by string, ribbon or elastic bands and in certain highly specialized retail outlets may also be provided with decorative accessories such as bows or rosettes.

The present invention is directed to meeting the problem of producing an acceptable package which a customer will be pleased to take along wherein the elements of the package may be stored flat and wherein the completion and securement of the package is achieved by the novel sleeve with pre-applied handle for setup box or folding carton of the present invention.

Thus, in accordance with the present invention, the container which is to be secured may be a folding integral box or a collapsed or setup bottom section and lid section which are placed together without any means being required on the folding box or the bottom container and lid for interlocking the same; thereafter a sleeve in accordance with the present invention may be slipped over the box, the sleeve being dimensioned so that it will fit one circumferential section of the box. The sleeve is also provided with a handle.

The sleeve may thus provide an ornamental finished appearance for the box and may also in itself be appropriately ornamented in such a manner as to provide a highly acceptable package for carrying by the customer. The sleeve may also, in accordance with the present invention, be provided with a handle so that carrying of the package is facilitated by the sleeve itself without increasing the size of the package and without detracting from the appearance of the package; - and, in fact,adding to and enhancing the novel ornamental and acceptable appearance of the package.

The sleeve, since it is a tubular member, which, when erected, is preferably rectangular in cross-section may also be readily collapsed so that storage thereof is facilitated. While the sleeve is obviously more expensive than ordinary string or adhesive tape, the fact that the sleeve may simply be opened and slid over the package saves the time of the cashier, packer and customer and therefore acts to increase the goodwill of the store. Since the sleeve as above pointed out may readily be ornamented or itself be an ornamental structure, the ornamentation such as ribbons, bows and rosettes will not be needed when the sleeve is used.

Accordingly, the principal object of the present invention is the provision of a novel sleeve with preapplied handle for a setup box or folding carton wherein the sleeve may readily be slid over the completed folding setup box or folding carton or over a setup box and lid structure to complete the structure of the box, ensure that it remains closed, provide an ornamental appearance and also provide a handle; while at the same time the sleeve may be readily stored in collapsed condition, thereby increasing the availability of a large number of sleeves to the person making the packages.

The foregoing and many other objects of the present invention will become apparent in the following description and drawings in which:

FIG. 1 is a view in perspective of either a setup box or folding carton, the closure of which has been completed by the novel sleeve with pre-applied handle of the present invention.

FIG. 2 is a view in perspective of the sleeve alone before it is slipped over the handle.

FIG. 3 is a view in perspective corresponding to that of FIG. 2, but showing the method of completion of the sleeve structure, while the sleeve structure may be completed in its flat condition, the purpose of this Figure is to demonstrate in more readily visible form how the parts are assembled.

FIG. 4 is a cross-sectional view taken on line 4—4 of FIG. 2 looking in the direction of the arrows.

FIG. 5 is a side view of the sleeve in collapsed condition.

Referring now to the Figures, the carton 10 may be a folding carton or a setup box with a lid comprising a bottom section 11 and a lid section 12. In the usual package of this type the lid section 12 is so arranged that it usually completely encloses the four sides of the bottom section 11 whether the box is a setup box or a folding carton. The primary reason for this is that in many such cartons the bottom section of either a folding carton or the setup box is often provided with some handle member and the lid member is often provided with a slot through which the handle member protrudes in order to lock the lid and the bottom container togeter. This is particularly so in the case of folding cartons used for wrapping and delivery of merchandise such as clothing. With the use of the sleeve of the present invention, as hereinafter described, such complete overlapping of the walls of the lid 12 over the walls of the bottom container 11 is unnecessary, thereby resulting in saving of paper or fiberboard, especially when the vast quantity of such cartons in use is kept in mind.

The carton is then held in closed position by the sleeve 20 which in the erected position consists of a pair of side walls 21, 22, a top wall 23 and a bottom wall 24*a*. The top wall 23 consists of a panel 24 connected by the fold line 25 to the sidewall 21 and an additional panel 26 connected by the fold line 27 to the side wall 22. The additional panel 26 is provided with a slot 30, and the outer surface of the additional panel 24 is provided with the collapsible handle 31 which, when the sleeve is completed, permits the handle 31 to protrude through the slot 30. The handle in this case is a paper or plastic handle or of other material of substantial strength adhesively secured at the ends 32, 33 to the outer surface of the panel 24. In order to ensure that such securement will resist any pulling out of the handle 31, the securement may be reinforced by an additional paper strip 35 having slots 35, 37 through which the handle 31 projects and beyond each of which the sections 32 and 33 of the handle extends. The paper strip 35 is adhesively secured to the outer surface of the panel 24 and thus holds the handle 31 securely in place. The handle 31 may be flexible but also for purposes of ensuring collapse in a predetermined manner substantially within the confines of the slot 30, the handle 31 may be precreased at 40. The precreasing ensures that the handle will not be randomly wrinkled by being squeezed by cartons above it or below it in a pile but will be forced down into the slot 30 during storage in a predictable way.

The various elements of the top member of the sleeve 20 as shown in FIG. 3 and as completed in FIG. 2 by the gluing down of the panel 26 on top of the panel 24 as shown in FIG. 2 are also shown in cross-section in FIG. 4.

FIG. 5 demonstrates how the sleeve of FIGS. 1, 2, 3 and 4 may readily be collapsible to flat position by being folded about the fold lines 25, 27, 43 and 42.

Thus it may be seen that the novel sleeve with preapplied handle for a setup box or folding carton of the present invention may readily be stored in collapsed condition in a pile with all of the sleeves being in the form shown in FIG. 5. The sleeves may be readily erected and slipped onto the carton 10 in order to provide a simple closure or binding for the carton 10 and to provide a carrying handle therefor.

It was pointed out above that part of the wall of the cover 12 of the carton is frequently extended to completely enclose the side walls of the container section 11 of the carton 10; also as above pointed out this was primarily done to ensure either neatness of appearance or in the case of a folding carton the interengagement or securement of the parts. In the sleeve of the present invention there can be some substantial saving of paper in the formation of the lid of the carton; this saving over a production run of many hundreds of thousands of such cartons will be substantial. It might be said that this saving is in part offset by the utilization of similar fiberboard for the sleeve. However, the sleeve while it uses additional paper or fiberboard eliminates the need for string, adhesive closure or ribbon closures and, most important, saves substantial time at a checkout counter, cashier or packing station.

In addition, since the sleeve is slipped over the carton providing a handle for carrying the carton and also in effect seals the carton for carrying purposes, it also may be appropriately ornamented to be compatible with a design on the carton or complementary with an imprinted design on the carton and may itself provide an oranmental finish or exterior for the carton which will make it highly acceptable to the customer.

Not only may the sides of the sleeve be appropriately ornamented to correspond with the package and to contain other ornamentation, but the sides may themselves be varied in shape. They may also be varied to provide openings or other patterns within the sides to produce an additional ornamental effect. The sides as well as the top may be die cut to match, when centered on the package, predetermined graphic designs on the package itself.

This ornamentation may well increase the number of packages that are taken along by the customer rather than left for delivery which may result in important reduction in operating expenses of the establishment which utilizes this type of carton. Hence, while more paper may actually be used in the combination of carton and sleeve, the saving to the retail establishment in time and other materials, the provision of material which may make the ornamenting or decoration of the package a simplified matter and the increase in acceptance of the carton for taking along by the customer provides substantial savings which far out weigh the possible cost of additional paper which may be used.

In the foregoing the present invention has been described in connection with specific illustrative embodiments thereof. Since many variations and modifications of the present invention will now be obvious to those skilled in the art, it is preferred that the scope of this invention be determined not by the specific disclosures herein contained but only by the appended claims.

What is claimed is:

1. A sleeve and handle for a rectilinear package; said sleeve being adapted to maintain the package in closed position when placed on said package; said handle being connected to and a part of said sleeve;

said sleeve comprising a tubular member having a pair of side walls each connected by hinge lines to a top and bottom wall; said tubular member being erectable and collapsible around said fold lines;

said sleeve when erected comprising a pair of opposed parallel side walls and opposed parallel top and bottom walls; the cross-sectional area of said erected tubular sleeve being of a dimension to match corresponding dimensions of said package;

said sleeve being capable of being slipped on and off said package and being dimensioned to have a substantial frictional fit on said package;

the top wall of said sleeve having a handle formed therein and comprising at least a pair of superimposed upper and lower panels; one of said panels being hingedly connected to one side wall; the other of said panels being hingedly connected to the other side wall; the upper panel of said superimposed panels having a slot therein; a flexible handle member secured between said superimposed panels and extending in said slot; said handle member being depressible into said slot to be wholly within the boundary of said upper panel; said handle being capable of being raised out of said slot for grasping by the hand and comprising a ribbon; the ends of said ribbon being secured to the lower of the two superimposed panels forming the top wall and at least one section of the ribbon adjacent one end of the slot being prefolded to ensure a controlled collapse of said handle within said slot, said top wall further including a reinforcing member for further securing said handle member to said lower panel and to reinforce said slot in said upper panel, said reinforcing member including a single sheet with openings therein, said sheet being adhesively secured to the upper surface of said lower panel with the ends of said ribbon handle being captured through said openings, between said sheet and said lower panel.

2. The sleeve and handle for a rectilinear package of claim 1, wherein said package carries graphic markings thereon and wherein at least one of the side walls of said sleeve is shaped to correspond and cooperate with said graphic markings.

3. The sleeve and handle for a rectilinear package of claim 2, said shaping comprising a formation other than linear of at least one edge of said side wall.

4. The collapsible sleeve of claim 2, wherein said side wall is provided with openings cooperating with said graphic markings on said package.

* * * * *